US011322066B2

(12) United States Patent
Kim et al.

(10) Patent No.: US 11,322,066 B2
(45) Date of Patent: May 3, 2022

(54) PANEL CONTROL CIRCUIT AND DISPLAY DEVICE INCLUDING THE SAME

(71) Applicant: Magnachip Semiconductor, Ltd., Cheongju-si (KR)

(72) Inventors: Hyoung Kyu Kim, Cheongju-si (KR); Yeon Kyoung Park, Incheon (KR); Dae Young Yoo, Sejong-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 17/134,763

(22) Filed: Dec. 28, 2020

(65) Prior Publication Data

US 2021/0358370 A1 Nov. 18, 2021

(30) Foreign Application Priority Data

May 18, 2020 (KR) ..... 10-2020-0059352

(51) Int. Cl.
*G09G 3/20* (2006.01)

(52) U.S. Cl.
CPC ..... *G09G 3/20* (2013.01); *G09G 2310/0272* (2013.01); *G09G 2310/0291* (2013.01); *G09G 2310/0297* (2013.01)

(58) Field of Classification Search
CPC ..... G09G 3/20; G09G 2310/0291; G09G 2310/0297; G09G 2310/0272
See application file for complete search history.

(56) References Cited

U.S. PATENT DOCUMENTS

| | | | | |
|---|---|---|---|---|
| 8,704,814 | B2 * | 4/2014 | Yen | G09G 3/20 345/211 |
| 9,196,207 | B2 | 11/2015 | Lee | |
| 2018/0211620 | A1 * | 7/2018 | Kurokawa | G06N 3/0481 |
| 2018/0226034 | A1 * | 8/2018 | Takahashi | G06F 1/3262 |
| 2019/0088229 | A1 * | 3/2019 | Morita | G09G 3/3696 |
| 2020/0105203 | A1 * | 4/2020 | Kim | G09G 3/3233 |
| 2021/0011505 | A1 * | 1/2021 | Chien | G05F 1/575 |
| 2021/0056930 | A1 * | 2/2021 | Kang | G09G 3/20 |

* cited by examiner

*Primary Examiner* — Andrew Sasinowski
(74) *Attorney, Agent, or Firm* — NSIP Law

(57) ABSTRACT

A panel control circuit configured to control a display panel includes a plurality of pixels. The panel control circuit includes a controller configured to output an image data and a source driver, including an output circuit and an output control circuit, configured to generate data signals based on the image data. The controller is configured to output an output change signal for changing an output of the source driver. The output circuit is configured to output the data signals to the display panel, and the output control circuit is configured to output an adjusting current to the output circuit in a signal transition section of the output change signal.

20 Claims, 9 Drawing Sheets

PANEL CONTROL CIRCUIT AND DISPLAY DEVICE INCLUDING THE SAME

CROSS-REFERENCE TO RELATED APPLICATIONS

This application claims the benefit under 35 USC 119(a) of Korean Patent Application No. 10-2020-0059352 filed on May 18, 2020, in the Korean Intellectual Property Office, the entire disclosure of which is incorporated herein by reference for all purposes.

BACKGROUND

1. Field

The following relates to a panel control circuit and a display device, including the same.

2. Description of Related Art

A display device may include a display panel and a panel control circuit configured to control the display panel. The panel control circuit can transmit data signals to the display panel.

The display device is generally controlled in units of rows and the control time, in units of rows (horizontal cycle, 1H), tends to gradually decrease due to the increase of the resolution of the display device. Accordingly, the slew rate of the panel control circuit, which outputs the data signals is now more desirable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a panel control circuit configured to control a display panel includes a plurality of pixels. The panel control circuit includes a controller configured to output an image data and a source driver, including an output circuit and an output control circuit, configured to generate data signals based on the image data. The controller is configured to output an output change signal for changing an output of the source driver. The output circuit is configured to output the data signals to the display panel, and the output control circuit is configured to output an adjusting current to the output circuit in a signal transition section of the output change signal.

The source driver may be further configured to change a level of the data signal in response to the output change signal.

The source driver may further include an input circuit configured to process the image data and output the processed image data, and a conversion circuit configured to generate gamma voltages based on the processed image data. The output circuit may include operational amplifiers configured to convert the gamma voltages into the data signals and output the data signals, and the output control circuit may be configured to transmit the adjusting current to the operational amplifiers.

The input circuit may include latches configured to latch the image data and output the latched image data to the conversion circuit in response to the output change signal.

The input circuit may include multiplexers configured to receive a first image data and a second image data, and output any one of the first image data and the second image data to the conversion circuit in response to the output change signal.

The output circuit may further include an output switching circuit configured to switch the data signals output from the operational amplifiers in response to the output change signal.

The output switching circuit may include a first switch configured to connect a first operational amplifier, among the operational amplifiers, and a first output pad of the source driver, and a second switch configured to connect the first operational amplifier and a second output pad of the source driver. The first switch and the second switch may be turned on and turned off in response to the output change signal.

The output control circuit may be further configured to output the adjusting current to the output circuit in a predetermined signal transition section based on a point of time when the level of the output change signal changes.

The controller may be further configured to generate an adjustment initiation signal having a first level in a predetermined signal transition section based on a point of time when the level of the output change signal changes, and output the generated adjustment initiation signal to the output control circuit. The output control circuit may be further configured to transmit the adjusting current to the output circuit in response to the adjustment initiation signal.

The output control circuit may be further configured to transmit the adjusting current and a bias current to the output circuit when the adjustment initiation signal is at the first level, and only transmit the bias current, among the adjusting current and the bias current, to the output circuit when the adjustment initiation signal is at a second level different from the first level.

The controller may be further configured to set timings of a rising edge and a falling edge of the adjustment initiation signal based on a point of time when the level of the output change signal changes.

The falling edge of the adjustment initiation signal and the point of time when the level of the output change signal changes may be located at different horizontal time periods.

The controller may include a memory configured to store a timing setting value, and may determine the predetermined signal transition section based on the timing setting value stored in the memory and the point of time when the level of the output change signal changes.

The output control circuit may include an adjusting circuit configured to output the adjusting current, and a switch configured to connect the adjusting circuit and the source driver and to output the adjusting current to the source driver in the signal transition section in which the level of the output change signal changes.

The panel control circuit may be disposed in a display device.

In another general aspect, a display device includes a display panel including a plurality of pixels, a controller configured to output an image data, and a source driver, including an output circuit and an output control circuit, configured to generate data signals based on the image data. The controller is configured to output an output change signal for changing an output of the source driver. The output circuit is configured to output the data signals to the display panel. The output control circuit is configured to transmit a bias current to the output circuit and transmit an adjusting current to the output circuit in a signal transition section of the output change signal.

The output control circuit may be further configured to output the adjusting current to the output circuit in a predetermined signal transition section based on a point of time when the level of the output change signal changes.

The controller may be further configured to generate an adjustment initiation signal having a first level in a predetermined signal transition section, based on a point of time when the level of the output change signal changes, and output the generated adjustment initiation signal to the output control circuit. The output control circuit may be further configured to transmit the adjusting current to the output circuit in response to the adjustment initiation signal.

The output control circuit may be further configured to transmit the adjusting current and a bias current to the output circuit when the adjustment initiation signal is at the first level, and only transmit the bias current, among the adjusting current and the bias current, to the output circuit when the adjustment initiation signal is at a second level different from the first level.

The controller may be further configured to set timings of a rising edge and a falling edge of the adjustment initiation signal based on a point of time when the level of the output change signal changes.

The falling edge of the adjustment initiation signal and the point of time when the level of the output change signal changes maybe located at different horizontal time periods.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
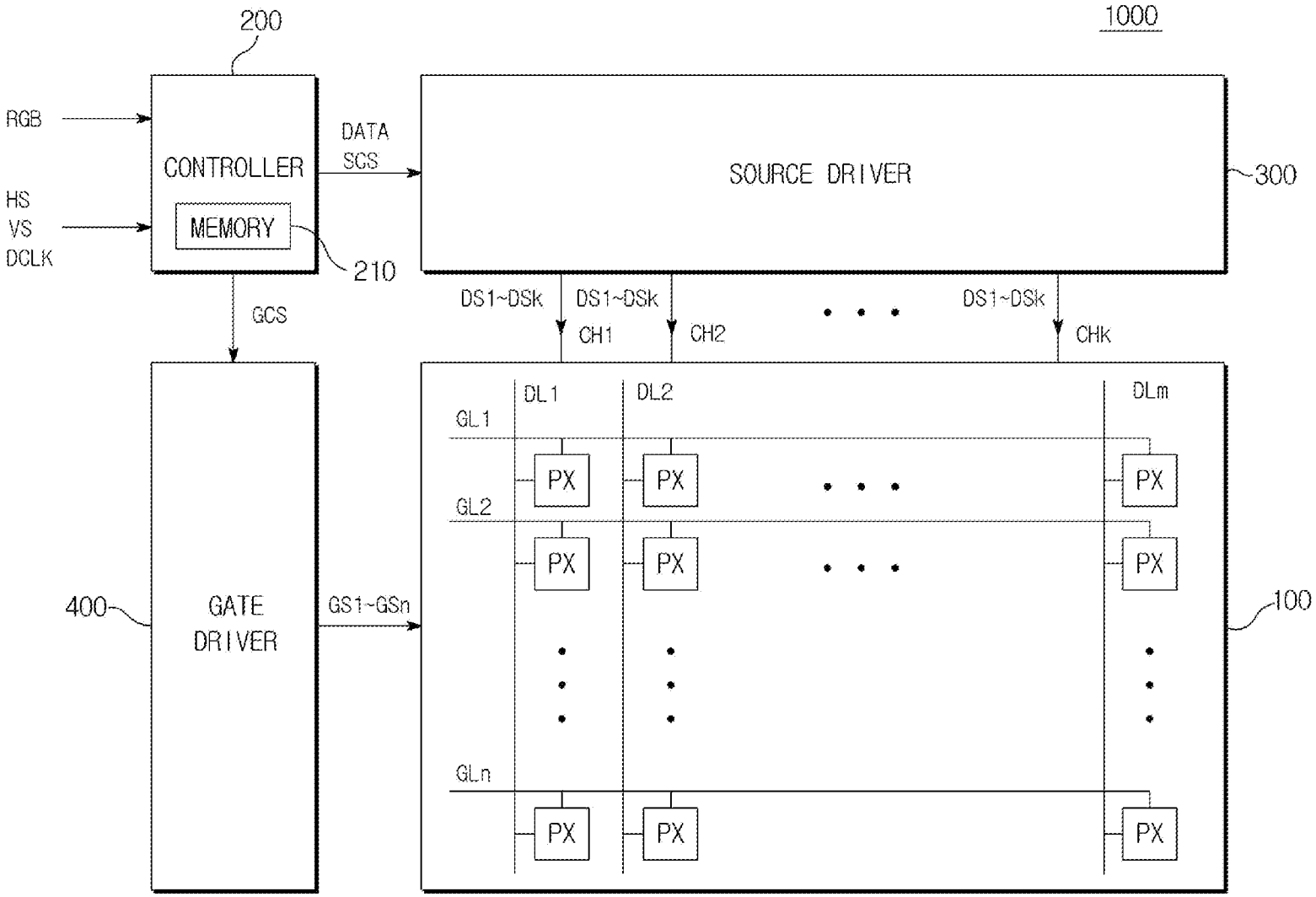
FIG. 1 is a diagram illustrating an example of a display device.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known after understanding of the disclosure of this application may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways, as will be apparent after an understanding of the disclosure of this application. Further, although the examples described herein have a variety of configurations, other configurations are possible, as will be apparent after an understanding of the disclosure of this application.

The purpose of the present disclosure is to improve the slew rate of a source driver and to minimize the increase of power consumption through the improvement of the slew rate.

FIG. 1 is a diagram illustrating an example of a display device. In FIG. 1, for example, the display device 1000 includes a display panel 100, a controller 200, a source driver 300, and a gate driver 400.

In one or more examples, the display device 1000 may display images or videos. For example, the display device 1000 may be, or embodied in, a smartphone, a tablet personal computer (PC), a computer, a camera, or wearable devices, etc., and is not limited thereto.

The display panel 100 may include a plurality of sub-pixels PX which are arranged in rows and columns. In one or more examples, the plurality of sub-pixels PX shown in FIG. 1 may be arranged in a lattice structure composed of n rows and m columns (n and m are natural numbers).

For example, the display panel 100 may be implemented with one of liquid crystal display (LCD), light-emitting diode (LED) display, organic light-emitting diode (OLED) display, active-matrix OLED (AMOLED) display, Electrochromic Display (ECD), Digital Mirror Device (DMD), Actuated Mirror Device (AMD), Grating Light Valve (GLV), Plasma Display Panel (PDP), Electro Luminescent Display (ELD), and Vacuum Fluorescent Display (VFD), and is not limited thereto.

In one or more examples, the display panel 100 may include n gate lines GL1 to GLn, arranged in n rows, and m data lines DL1 to DLm, arranged in m columns. The sub-pixels PX may be disposed at intersections of the gate lines GL1 to GLn and the data lines DL1 to DLm.

In one or more examples, the sub-pixels PX of the display panel 100 may be driven in units of gate lines. For example, the sub-pixels arranged in one gate line may be driven during a first section, and the sub-pixels arranged in another gate line may be driven during a second section next to the first section. Here, a unit time interval during which the sub-pixels PX are driven may be referred to as one horizontal (1H) time period.

The sub-pixels PX may include a light-emitting device configured to emit light and a light-emitting device driving circuit which drives the light-emitting device. The light-emitting device driving circuit may be connected to one gate line and one data line. The light-emitting device may be connected between the light-emitting device driving circuit and a power voltage (for example, a ground voltage).

In one or more examples, the light-emitting device may be a light-emitting diode (LED), an organic LED (OLED), a quantum dot LED (QLED), or a micro LED, and is not limited thereto.

Each of the sub-pixels PX may be one of a red element R outputting red light, a green element G outputting green light, a blue element B outputting blue light, and a white element W outputting white light. In the display panel 100, the red element, the green element, the blue element, and the white element may be arranged in various ways. In one or more examples, the sub-pixels PX of the display panel 100 may be arranged repeatedly in the order of R, G, B, G, or B, G, R, G, or R, G, B, W, etc. For example, the sub-pixels PX of the display panel 100 may be arranged according to an RGB stripe structure, an RGB Pentile structure, and an RGBW array structure.

The light-emitting device driving circuit may include a switching device connected to the gate lines GL1 to GLn, for example, a thin film transistor (TFT). When a gate-on signal is applied from the gate lines GL1 to GLn and the switching element is turned on, the light-emitting device driving circuit may provide the light-emitting device with a data signal (or referred to as a pixel signal), received from the data lines DL1 to DLm connected to the light-emitting device driving circuit. The light-emitting device may output light corresponding to an image signal.

The controller 200 may receive the image signal RGB externally, perform image processing on the image signal RGB, or convert the image signal to match the structure of the display panel 100 to generate an image data DATA. The controller 200 may transmit the image data DATA to the source driver 300.

The controller 200 may receive a plurality of control signals from an external host device. The control signals may include a horizontal synchronization signal HS, a vertical synchronization signal VS, and a clock signal DCLK.

The controller 200 may generate a source control signal SCS and a gate control signal GCS for controlling the source driver 300 and the gate driver 400 based on the received control signals. In one or more examples, the controller 200 may generate the source control signal SCS and the gate control signal GCS based on the horizontal synchronization signal HS.

The controller 200 may control operation timings of the source driver 300 and the gate driver 400 based on the source control signal SCS and the gate control signal GCS.

In one or more examples, the controller 200 may transmit the source control signal SCS to the source driver 300, and the source driver 300 may output the data signals to a plurality of the data lines DL1 to DLm based on the received source control signal SCS. In one or more examples, the controller 200 may transmit the gate control signal GCS to the gate driver 400, and the gate driver 400 may output gate signals to a plurality of the gate lines GL1 to GLn based on the received gate control signal GCS.

The controller 200 may include a memory 210, which stores data for controlling the source driver 300 and the gate driver 400. The memory 210 may store set values required to generate the control signals (e.g., the source control signal SCS or the gate control signal GCS) for controlling the source driver 300 and the gate driver 400. For example, the memory 210 may include at least one of non-volatile memory and volatile memory. The controller 200 may read the set values stored in the memory 210 and may generate the control signals by using the read set values.

In one or more examples, the memory 210 may include at least one register, and each of the at least one register may store the set value.

The source driver 300 may generate the data signals DS1 to DSk corresponding to the image displayed on the display panel 100, based on the image data DATA, and may transmit the generated data signals DS1 to DSk to the display panel 100. The data signals DS1 to DSk may be transmitted to each of the sub-pixels PX. For example, the source driver 300 may provide, during the 1H time period, the data signals DS1 to DSk to be displayed in the 1H time period, through the data lines DL1 to DLm, to the sub-pixels PX, which are driven during the 1H time period.

In one or more examples, the source driver 300 may receive the image data DATA and may generate the data signals DS1 to DSk by using gamma values corresponding to the image data DATA. Each of the data signals DS1 to DSk corresponds to the image data DATA, and is a signal for driving each of the sub-pixels PX. For example, the source driver 300 may output k data signals DS1 to DSk to the display panel 100.

The source driver 300 may generate the data signals DS1 to DSk based on the source control signal SCS. For example, the source control signal SCS may include a source start signal, a source shift clock, a source output enable signal, etc.

The gate driver 400 may sequentially provide the gate signals GS1 to GSn to the plurality of gate lines GL1 to GLn in response to the gate control signal GCS. For example, the gate control signal GCS may include a gate start pulse that instructs the start of the gate signal output, a gate shift clock that controls a gate-on signal output time point, and the like.

When the gate start pulse is applied, the gate driver 400 may generate a gate pulse in response to the gate shift clock, and may sequentially provide the gate signals GS1 to GSn to the gate lines GL1 to GLn using the gate pulse. Each of the gate signals GS1 to GSn is for turning on the sub-pixels PX connected to each of the gate lines GL1 to GLn. Each of the gate signals GS1 to GSn may be applied to a gate terminal of a transistor included in each of the sub-pixels PX.

In one or more examples, the gate driver 400 may transmit the gate signal with a high logic level to the gate line to which the sub-pixels PX to be driven are connected, and may transmit the gate signal with a low logic level to the gate line to which the sub-pixels PX not to be driven are connected. The gate signal with a high logic level may be referred to as the gate-on signal, and the gate signal with a low logic level may be referred to as a gate-off signal.

In one or more examples, the controller 200, the source driver 300, and the gate driver 400, described with reference to FIG. 1 may be referred to as a panel control circuit for controlling the display panel 100. Further, at least two of the controller 200, the source driver 300, and the gate driver 400 may be implemented as one integrated circuit. Further, in one or more examples, the gate driver 400 may be implemented by being mounted on the display panel 100.

Figure 2:
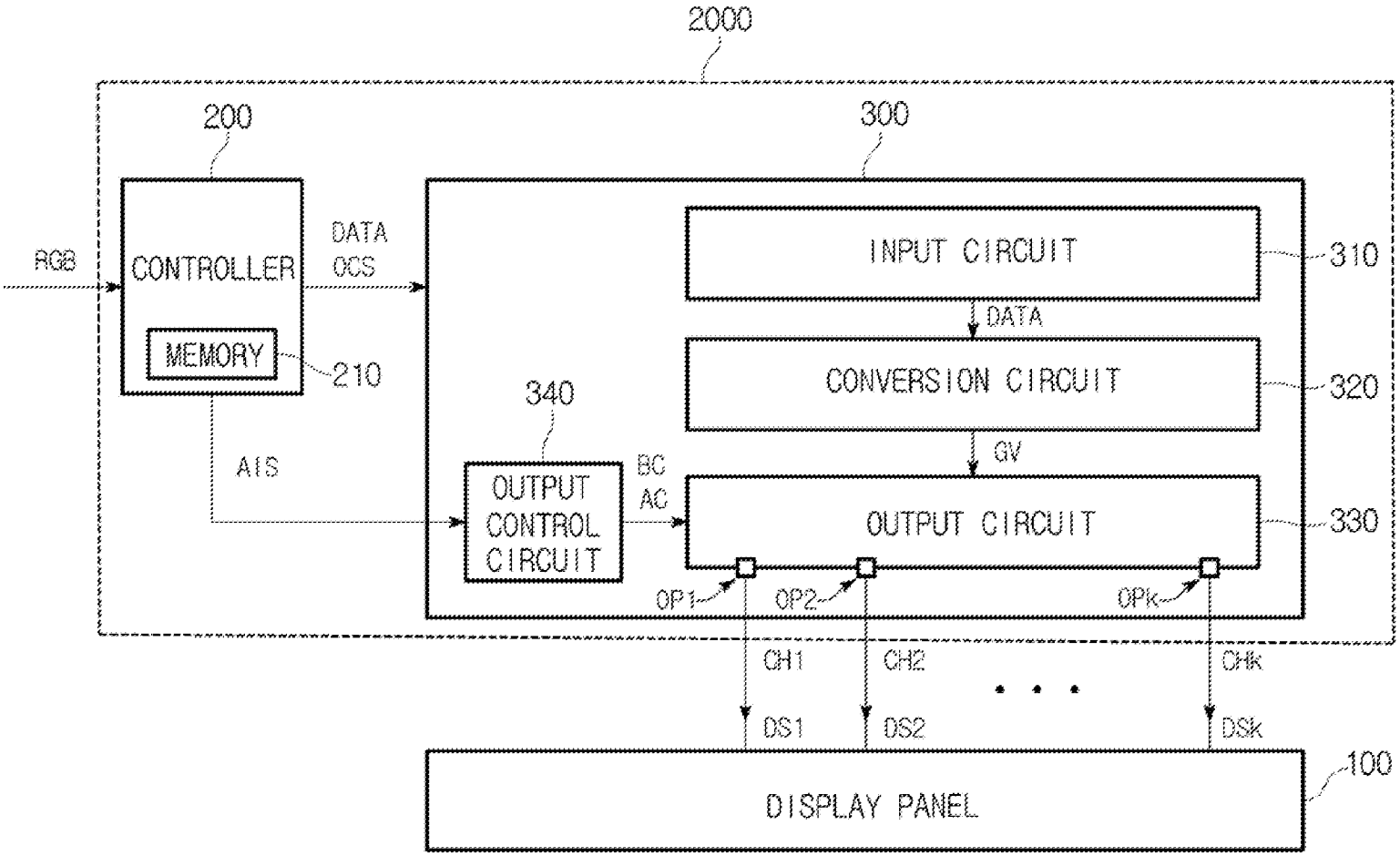
FIG. 2 is a diagram illustrating an example of a panel control circuit.

FIG. 2 is a diagram illustrating an example of the panel control circuit 2000. In FIGS. 1 and 2, for example, the source driver 300 may include an input circuit 310, a conversion circuit 320, an output circuit 330, and an output control circuit 340.

In one or more examples, the output control circuit 340 may be implemented separately from the source driver 300. For example, the output control circuit 340 may be implemented integrally with the controller 200, but is not limited thereto.

The input circuit 310 may receive the image data DATA transmitted from the controller 200, process the image data DATA, and output the processed image data DATA to the conversion circuit 320. In one or more examples, the input circuit 310 may sequentially output some of the image data DATA to the conversion circuit 320 after receiving the image data DATA represented by consecutive bits. For example, after receiving 16-bit image data DATA, the input circuit 310 may sequentially output the 16-bit image data DATA to the conversion circuit 320 by 8 bits.

In one or more examples, the input circuit 310 may include a latch for storing image data DATA and a multiplexer for selectively outputting the data transmitted from the latch to the conversion circuit 320. For example, after receiving 16-bit image data DATA, the input circuit 310 may sequentially output the 16-bit image data DATA to the conversion circuit 320 by 8 bits.

The conversion circuit 320 may generate gamma voltages GV by using the image data DATA output from the input circuit 310. In one or more examples, the conversion circuit 320 may generate the gamma voltages GV that is an analog voltage corresponding to a data value of the image data DATA.

The conversion circuit 320 may determine the analog voltage corresponding to the data value of the image data DATA by using pre-stored reference gamma voltages. In one or more examples, the conversion circuit 320 may interpolate the pre-stored reference gamma voltages to determine the analog voltage corresponding to the data value of the image data DATA. For example, when a first reference gamma voltage corresponding to a first data value and a second reference gamma voltage corresponding to a second data value are stored, the conversion circuit 320 may generate a gamma voltage corresponding to a third data value between the first data value and the second data value by interpolating the first reference gamma voltage and the second reference gamma voltage.

The conversion circuit 320 may transmit the generated gamma voltages GV to the output circuit 330.

In one or more examples, the conversion circuit 320 may include a level shifter for changing a level of the image data DATA transmitted from the input circuit 310, and a decoder that generates the gamma voltage by using the image data DATA which is transmitted from the level shifter (and has its changed level).

The output circuit 330 may receive the gamma voltages GV, generate the data signals DS1 to DSk by using the gamma voltages GV, and output the generated data signals DS1 to DSk to the display panel 100. In one or more examples, the output circuit 330 may generate the data signals DS1 to DSk by amplifying the gamma voltages GV. For example, the output circuit 330 may include an operational amplifier, and the operational amplifier may generate the data signals DS1 to DSk by amplifying the gamma voltages GV.

In one or more examples, k channels CH1 to CHk (k is a natural number) may be disposed between the source driver 300 and the display panel 100, and the data signals DS1 to DSk may be transmitted to the data lines DL1 to DLm through the k channels. Here, k that is the number of channels may be less than m that is the number of data lines DL1 to DLm, but is not limited thereto. When k that is the number of channels is less than m that is the number of data lines DL1 to DLm, the output circuit 330 may output at least two different data signals through each of the channels CH1 to CHk.

In one or more examples, the output circuit 330 may include k output pads OP1 to OPk assigned to each of the k channels CH1 to CHk. Each of the output pads OP1 to OPk may be disposed between the output circuit 330 and the k channels CH1 to CHk.

As described above, the controller 200 may control the source driver 300 by using the source control signal SCS. The source control signal SCS may include an output change signal OCS for changing the output of the source driver 300.

The source driver 300 may change the output of the source driver 300 in response to the output change signal OCS. In one or more examples, the source driver 300 may change the data signals DS1 to DSk in response to the output change signal OCS. For example, a level of the data signals DS1 to DSk output from the output pads OP1 to OPk may change in response to a change in a level of the output change signal OCS.

In one or more examples, the input circuit 310 may change the image data DATA to be output to the conversion circuit 320 in response to the output change signal OCS. In one or more examples, the input circuit 310 may output a first image data when the level of the output change signal OCS is a first level (e.g., a high level), and output a second image data when the level of the output change signal OCS is a second level (e.g., a low level). Accordingly, the output of the source driver 300 (e.g., the level of the output signal) may be changed.

In one or more examples, the output circuit 330 may change the data signals DS1 to DSk to be output to the output pads OP1 to OPk, in response to the output change signal OCS. In one or more examples, when the (logical) level of the output change signal OCS changes, the output circuit 330 may change the data signal output through the output pad. For example, the output circuit 330 may output a first data signal through a first output pad when the level of the output change signal OCS is the first level (e.g., a high level), and output the first data signal through a second output pad when the level of the output change signal OCS is the second level (e.g., a low level). Accordingly, the output of the source driver 300 may be changed.

The output control circuit 340 may control the output circuit 330. In one or more examples, the output control circuit 340 may supply an operating current required for the operation of the output circuit 330 to the output circuit 330, and may control a slew rate of the output circuit 330 by controlling the intensity of the operating current supplied to the output circuit 330.

The output circuit 330 may generate the data signals DS1 to DSk by using the gamma voltages GV. It is assumed that there is a level difference between the gamma voltages GV and the data signals DS1 to DSk. Ideally, the output circuit 330 may immediately respond to the application of the gamma voltages GV and output the data signals DS1 to DSk. However, actually, the transition between the gamma voltages GV and the data signals DS1 to DSk may take time (i.e., a transition time), and this transition time may be represented by the slew rate.

The slew rate of the output circuit 330 may be based on the intensity of the operating current supplied to the output circuit 330. However, when the intensity of the operating current supplied to the output circuit 330 is maintained high, there may be a side effect of increasing the power consumption of the source driver 300.

The output control circuit 340 may output the operating current to the output circuit 330. In one or more examples, the operating current output by the output control circuit 340 may include a bias current BC and an adjusting current AC.

In one or more examples, the output control circuit 340 may selectively output the adjusting current AC in a signal transition section in which the level of the output change signal that changes the output of the source driver 300 changes. For example, the output control circuit 340 may selectively output the adjusting current AC during a predetermined signal transition section based on the signal transition section in which the level of the output change signal that changes the output of the source driver 300 changes. That is, the magnitude of the operating current of the output circuit 330 may increase during a predetermined signal transition section based on a point of time when the output level changes.

In one or more examples, the output control circuit 340 may output the adjusting current AC to the output circuit 330 in a signal transition section in which the level of the data signals DS1 to DSk output from the source driver 300 changes. In other words, the output control circuit 340 may output the adjusting current AC to the output circuit 330 at a point of time when the level of the output change signal that changes the output of the source driver 300 changes. For example, the output control circuit 340 may supply the adjusting current AC to the output circuit for a certain period of time before and after a signal transition section in which the input of the output circuit 330 changes. As a result, the operating current, which has increased more than the existing bias current can be supplied to the output circuit 330 only at a point of time when the level of the output change signal that changes the output of the source driver 300 changes, so that the slew rate of the output circuit 300 can be increased and the power efficiency can be increased.

The output control circuit 340 may control the output of the adjusting current AC under the control of the controller 200. In one or more examples, the output control circuit 340 may control the output of the adjusting current AC in response to an adjustment initiation signal AIS transmitted from the controller 200. For example, the output control circuit 340 may output both the bias current BC and the adjusting current AC to the output circuit 330 when the adjustment initiation signal AIS transmitted from the controller 200 is at the first level (e.g., a high level), and may output only the bias current BC to the output circuit 330 when the adjustment initiation signal AIS is at the second level (e.g., a low level). The slew rate when both the bias current BC and the adjusting current AC are output to the output circuit 330 may be higher than the slew rate when only the bias current BC is output to the output circuit 330.

In one or more examples, the magnitude of the bias current BC may be equal to or greater than the magnitude of the adjusting current AC. For example, the bias current BC may be 3 mA and the adjusting current AC may be 2 mA, but are not limited thereto. Therefore, the operating current may be 3 mA when the adjusting current AC is not supplied, and the operating current may be increased to 5 mA when the adjusting current AC is supplied.

The controller 200 may output the adjustment initiation signal AIS at the first level to the output control circuit 340 for a certain period of time before and after a point of time when the level of the output change signal OCS changes. Therefore, the output control circuit 340 may output the adjusting current AC to the output circuit 330 at a point of time when the level of the output change signal that changes the output of the source driver 300 changes in response to the adjustment initiation signal AIS at the first level.

The controller 200 may output the adjustment initiation signal AIS based on the output change signal OCS. In one or more examples, the controller 200 may output the adjustment initiation signal AIS having the first level during a predetermined signal transition section based on a point of time when the level of the output change signal OCS changes. As it were, the adjustment initiation signal AIS may have the first level during a predetermined signal transition section from a rising edge or a falling edge of the output change signal OCS.

The controller 200 may read the set values for the adjustment initiation signal AIS stored in the memory 210 and may generate the adjustment initiation signal AIS based on the read set values.

In one or more examples, the memory 210 may store a mode set value, and the controller 200 may determine the level of the adjustment initiation signal AIS based on the mode set value. For example, the controller 200 may generate the adjustment initiation signal AIS having the first level when the mode set value is a first value (logical high), and may generate the adjustment initiation signal AIS having the second level when the mode set value is a second value (logical low).

In one or more examples, the memory 210 may store an intensity set value, and the controller 200 may determine an intensity of the adjusting current AC based on the intensity set value, and generate the adjustment initiation signal AIS for outputting the adjusting current AC having the determined intensity.

In one or more examples, the memory 210 may store a timing setting value for determining an output timing of the signals used in the display device 1000. In one or more examples, the memory 210 may store a timing setting value for determining the output timing of the output change signal OCS and a timing setting value for determining the output timing of the adjustment initiation signal AIS at the first level.

The controller 200 may set the output timing of the adjustment initiation signal AIS at the first level by using the timing setting value of the output change signal OCS. This will be described in more detail later.

As described above, the slew rate of the output circuit 330 when both the bias current BC and the adjusting current AC are supplied may be higher than the slew rate of the output circuit 330 when only the bias current BC is supplied. Accordingly, in one or more examples of the present disclosure, the output control circuit 340 may supply the bias current BC to the output circuit 330 at all times and may selectively supply the adjusting current AC to the output circuit 330. Accordingly, not only the slew rate of the output circuit 330 is increased, but also the increase in power consumption is minimized.

Figure 3:
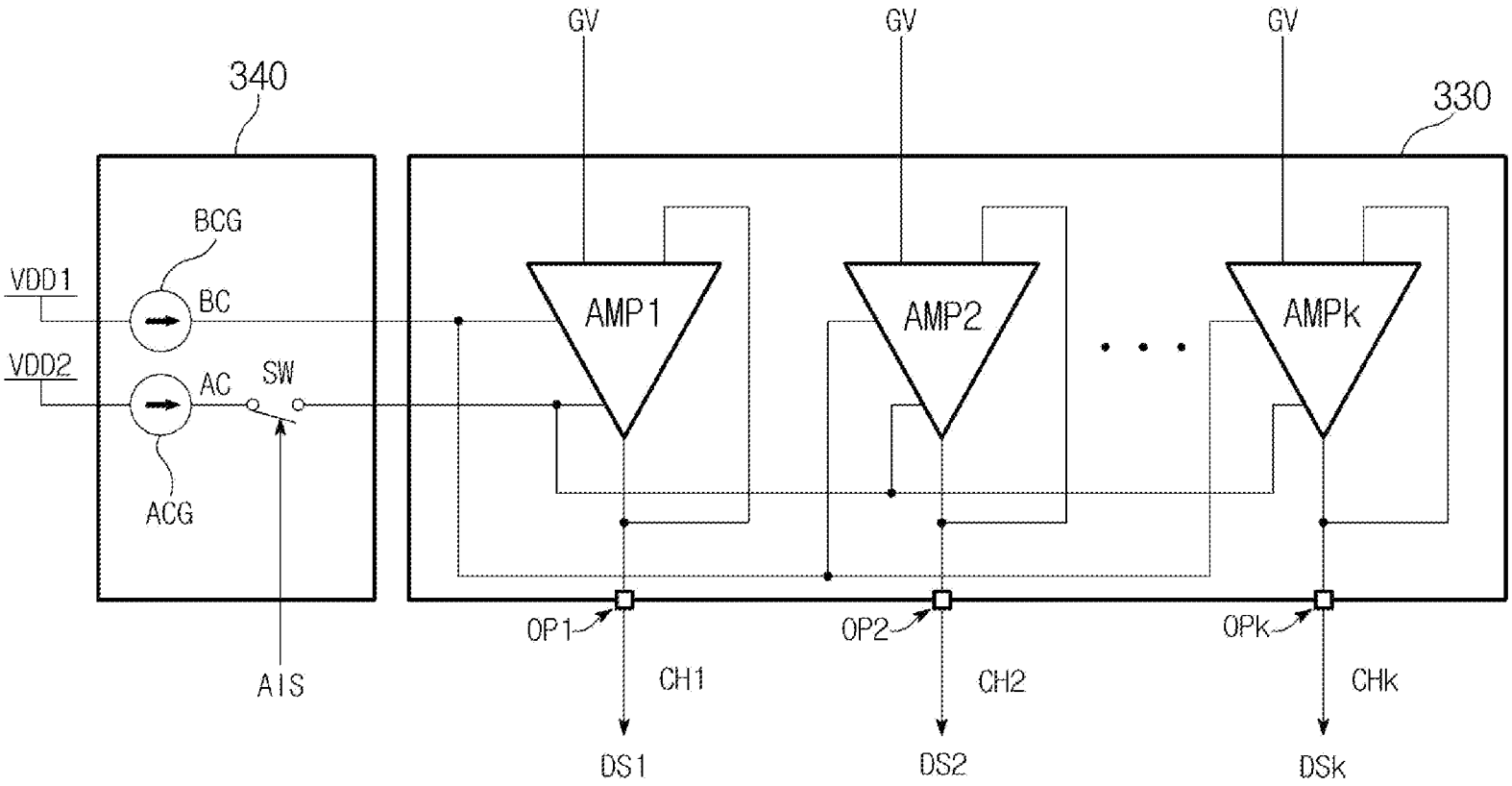
FIG. 3 is a diagram illustrating an example of an output control circuit and an output circuit.

FIG. 3 is a diagram illustrating an example of the output control circuit and the output circuit. In FIGS. 1 to 3, the output circuit 330 may include operational amplifiers AMP1 to AMPk.

The operational amplifiers AMP1 to AMPk may output the data signals DS1 to DSk by amplifying the input gamma voltages GV. In one or more examples, the operational amplifiers AMP1 to AMPk may output the data signals DS1 to DSk to the output pads OP1 to OPk. For example, the magnitude of the gamma voltages GV may be smaller than the magnitude of the data signals DS1 to DSk.

The operational amplifiers AMP1 to AMPk may operate based on the bias current BC. In one or more examples, the operational amplifiers AMP1 to AMPk may operate based additionally on the adjusting current AC.

The output control circuit 340 may include a bias current source BCG, an adjustable current source ACG, and a switch SW.

The bias current source BCG may generate the bias current BC by using a first power supply voltage VDD1. In one or more examples, the bias current source BCG may include a transistor such as a MOSFET, a FET, a BJT, etc., but is not limited thereto.

The bias current source BCG may generate the bias current BC under the control of the controller 200. In one or more examples, the bias current source BCG may change the magnitude of the bias current BC based on the control signal transmitted from the controller 200. That is, the magnitude of the bias current BC may change according to the control signal transmitted from the controller 200 to the bias current source BCG.

The adjustable current source ACG may generate the adjusting current AC by using a second power supply voltage VDD2. In one or more examples, the adjustable current source ACG may include a transistor such as a MOSFET, a FET, a BJT, etc., but is not limited thereto.

The adjustable current source ACG may generate the adjusting current AC under the control of the controller 200. In one or more examples, the adjustable current source ACG may change the magnitude of the adjusting current AC based on the control signal transmitted from the controller 200. That is, the magnitude of the adjusting current AC may change according to the control signal transmitted from the controller 200 to the adjustable current source ACG.

The switch SW may output the adjusting current AC transmitted from the adjustable current source ACG to the operational amplifiers AMP1 to AMPk. In one or more examples, the switch SW may selectively output the adjusting current AC to the operational amplifiers AMP1 to AMPk in response to the adjustment initiation signal AIS transmitted from the controller 200. For example, when the adjustment initiation signal AIS at the first level (e.g., a high level) is input, the switch SW may be turned on and output the adjusting current AC to the operational amplifiers AMP1 to AMPk, and when the adjustment initiation signal AIS at the second level (e.g., a low level) is input, the switch SW may be turned off and block the transmission of the adjusting current AC.

The output control circuit 340 is shown in FIG. 3 as including one adjustable current source ACG and one switch SW. However, in one or more examples, the output control circuit 340 may include a plurality of the adjustable current sources ACG and a plurality of the switches SW. When the plurality of adjustable current sources ACG and the plurality of switches SW are provided, the output control circuit 340 or the plurality of adjustable current sources ACG may selectively output a plurality of adjustable currents AC to the operational amplifiers AMP1 to AMPk, and the plurality of switches may allow (switch turn-on) or block (switch turn-off) the output of the plurality of adjustable currents AC. The controller 200 may output the control signals for controlling the plurality of adjustment current sources ACG, and may output a plurality of adjustment initiation signals AIS to the switches. Here, the number of adjustable current sources ACG may be less than or equal to the number of the plurality of operational amplifiers AMP1 to AMPk, but is not limited thereto.

Figure 4:
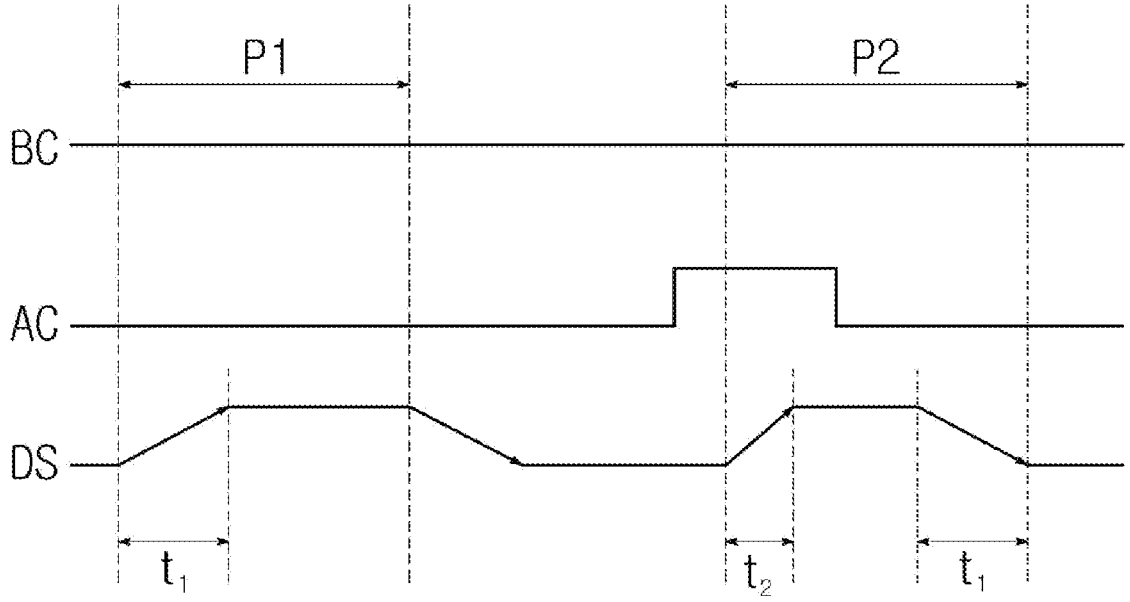
FIG. 4 is a diagram illustrating an example of a timing diagram showing a relationship between an adjusting current and a slew rate.

FIG. 4 is a diagram illustrating an example of a timing diagram showing a relationship between the adjusting current and the slew rate. In FIGS. 1 to 4, for example, two operation sections P1 and P2 of the source driver 300 are shown. In the first operation section P1 and the second operation section P2, the source driver 300 or the output circuit 330 outputs the data signal DS. For convenience, it is assumed that voltage levels of the data signal DS to be output in the first operation section P1 and the second operation section P2 is equal to each other.

In the first operation section P1, the bias current BC is applied, but the adjusting current AC is not applied. On the other hand, in the second operation section P2, both the bias current BC and the adjusting current AC are applied. Here, although not shown, the adjustment initiation signal AIS in the second operation section P2 may be at the first level (i.e., a high level).

In the first operation section P1, a first time span t1 is required for the data signal DS to be output at a target voltage level. In the second operation section P2, a second time span t2 is required for the data signal DS to be output at the target voltage level. Between the bias current BC and the adjusting current AC, only the bias current BC is applied in the first operation section P1, and both the bias current BC and the adjusting current AC are applied in the second operation section P2. Accordingly, the first time span t1 is longer than the second time span t2. That is, the slew rate of the output circuit 330 in the second operation section P2 to which the adjusting current AC is applied becomes higher. In other words, the slew rate of the output circuit 330 can be improved according to the application of the adjusting current AC.

Figure 5:
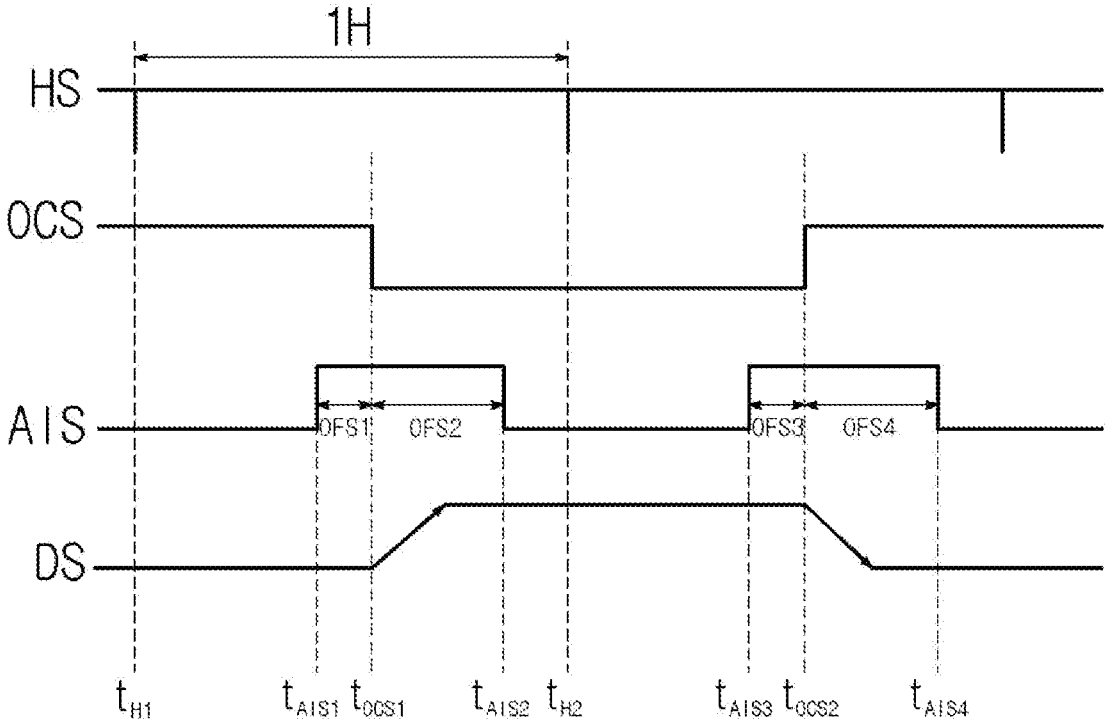
FIG. 5 is a diagram illustrating an example of a timing diagram describing the operation of the panel control circuit of signals.

FIG. 5 is a diagram illustrating an example of a timing diagram for describing the operation of the panel control circuit 2000. In FIGS. 1 to 5, for example, the horizontal synchronization signal HS, the output change signal OCS, the adjustment initiation signal AIS, and the data signal DS are shown.

The horizontal synchronization signal HS may be output in a constant cycle. In one or more examples, the controller 200 may receive the horizontal synchronization signal HS in a constant cycle.

The output change signal OCS may be for changing the level of the output of the source driver 300 (i.e., the data signal DS). In one or more examples, as described above, the output of the source driver 300 may be changed according to the level of the output change signal OCS or a change in the level of the output change signal OCS.

In one or more examples, the controller 200 may generate the output change signal OCS based on the received horizontal synchronization signal HS. For example, the controller 200 may change the level of the output change signal OCS based on a first edge $t_{H1}$ or a second edge $t_{H2}$ of the horizontal synchronization signal HS. That is, a first level change point $t_{OCS1}$ or a second-level change point $t_{OCS2}$ of the output change signal OCS may be spaced apart from the first edge $t_{H1}$ or the second edge $t_{H2}$ of the horizontal synchronization signal HS by a constant distance. Accordingly, the cycle of the output change signal OCS may be the same as the cycle of the horizontal synchronization signal HS.

The adjustment initiation signal AIS may instruct the supply of the adjusting current AC to the source driver 300.

The controller 200 may set the output timing of the adjustment initiation signal AIS based on the output timing of the output change signal OCS, and output the adjustment initiation signal AIS according to the set timing.

The controller 200 may output the adjustment initiation signal AIS having the first level (e.g., a high level) based on a signal transition section in which the level of the output change signal OCS changes. In one or more examples, the controller 200 may output the adjustment initiation signal AIS having the first level (e.g., a high level) based on a signal transition section in which the logical level of the output change signal OCS changes. In this specification, "a point of time when the logical level changes" may mean that a point of time when the logic level of the signal changes from a high level to a low level or from a low level to a high level.

That is, the controller 200 may output the adjustment initiation signal AIS having a timing in conjunction with the timing of the output change signal OCS. In one or more examples, at least one of a rising edge and a falling edge of the adjustment initiation signal AIS may be based on the signal transition section in which the level of the output change signal OCS changes.

The controller 200 may read the timing setting value from the memory 210 and output the adjustment initiation signal AIS at the first level during a signal transition section having a predetermined offset from the point of time at which the level of the output change signal OCS changes, based on the read timing setting value. In one or more examples, the controller 200 may output the adjustment initiation signal AIS by using the timing setting value indicating the point of time at which the level of the output change signal OCS changes and the timing setting value indicating the predetermined offset.

The controller 200 may output the adjustment initiation signal AIS having the first level during a section, which is determined by a time point before the first offset OFS1 from the first level change point $t_{OCS1}$ of the output change signal OCS and by a time point after the second offset OFS2.

In one or more examples, the controller 200 may output the adjustment initiation signal AIS such that a first rising edge $t_{AIS1}$ of the adjustment initiation signal AIS is before the first offset OFS1 from the first level change point $t_{OCS1}$ of the output change signal OCS. Here, the first rising edge $t_{AIS1}$ of the adjustment initiation signal AIS and the first level change point $t_{OCS1}$ of the output change signal OCS may be located within one horizontal time period.

In one or more examples, the controller 200 may output the adjustment initiation signal AIS such that a first falling edge $t_{AIS2}$ of the adjustment initiation signal AIS is after the second offset OFS2 from the first level change point $t_{OCS1}$ of the output change signal OCS.

In one or more examples, the first falling edge $t_{AIS2}$ of the adjustment initiation signal AIS may be located outside the 1H time period. For example, the first falling edge $t_{AIS2}$ of the adjustment initiation signal AIS and the first level change point $t_{OCS1}$ of the output change signal OCS may be located at different horizontal time periods. However, the embodiments of the present disclosure are not limited thereto.

The controller 200 may output the adjustment initiation signal AIS having the first level during a section which is determined by a time point before a third offset OFS3 from the second level change point $t_{OCS2}$ of the output change signal OCS and by a time point after a fourth offset OFS4.

In one or more examples, the controller 200 may output the adjustment initiation signal AIS such that a second rising edge $t_{AIS3}$ of the adjustment initiation signal AIS is before the third offset OFS3 from the second level change point $t_{OCS2}$ of the output change signal OCS. Here, the second rising edge $t_{AIS3}$ of the adjustment initiation signal AIS and the second level change point $t_{OCS2}$ of the output change signal OCS may be located within one horizontal time period.

In one or more examples, the controller 200 may output the adjustment initiation signal AIS such that a second falling edge $t_{AIS4}$ of the adjustment initiation signal AIS is after the fourth offset OFS4 from the second level change point $t_{OCS2}$ of the output change signal OCS.

In one or more examples, the second falling edge $t_{AIS4}$ of the adjustment initiation signal AIS may be located outside the 1H time period. In other words, the second falling edge $t_{AIS4}$ of the adjustment initiation signal AIS and the second level change point $t_{OCS2}$ of the output change signal OCS may be located at different horizontal time periods. However, the embodiments of the present disclosure are not limited thereto.

The timing setting value for setting the first to fourth offsets OFS1 to OFS4 may be stored in the memory 210.

The output change signal OCS may be a signal for changing the output of the data signal DS. Therefore, according to the above, the adjustment initiation signal AIS may be output to the source driver 300 before and after a signal transition section in which the output of the data signal DS changes. Therefore, since the adjusting current AC may be selectively supplied to the source driver 300 when the level of the output change signal OCS which changes the output of the source driver 300 changes, the slew rate of the source driver 300 increases and the increase in the power consumption can be minimized.

Figure 6:
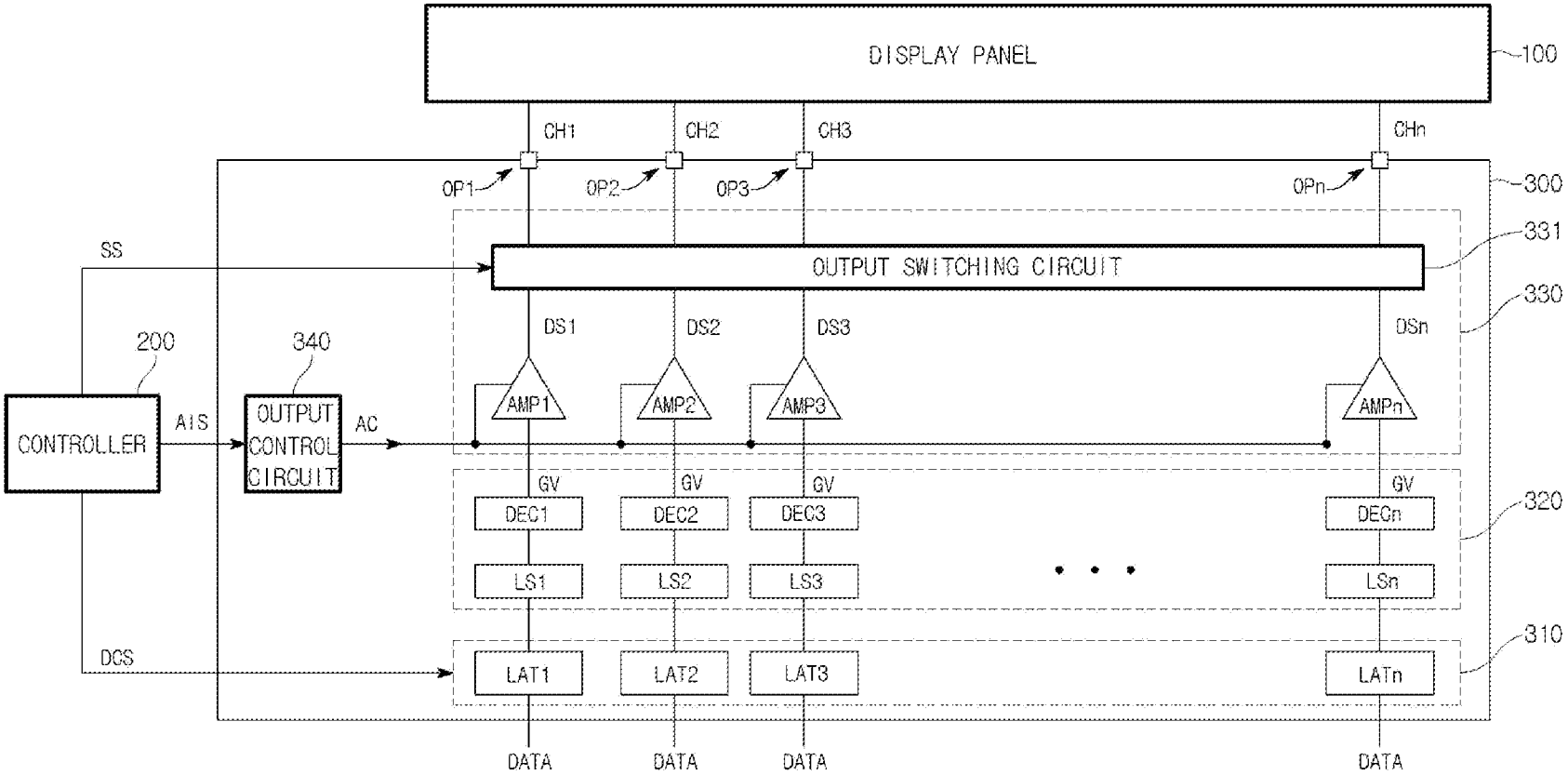
FIG. 6 is a diagram illustrating an example of a display panel and the panel control circuit.

FIG. 6 is a diagram illustrating an example of the display panel and the panel control circuit 2000. In FIGS. 1 to 6, for example, the source driver 300 is connected to the display panel 100 by n channels CH1 to CHn, and the source driver 300 may include n output pads OP1 to OPn assigned to channels CH1 to CHn, respectively.

The input circuit 310 may include latches LAT1 to LATn that latch the image data DATA. The latches LAT1 to LATn of the input circuit 310 may latch the image data DATA and output the latched image data to the conversion circuit 320.

In one or more examples, the latches LAT1 to LATn may output the latched image data to the conversion circuit 320 based on the control of the controller 200. In one or more examples, the controller 200 may output a data change signal DCS to the latches LAT1 to LATn, and the latches LAT1 to LATn may output the latched image data to the conversion circuit 320 based on the data change signal DCS. Since the image data input to the conversion circuit 320 changes according to the data change signal DCS, the output of the source driver 300 may consequently change according to the data change signal DCS. Therefore, it can be understood that the output change signal OCS of the embodiments of the present disclosure includes the data change signal DCS.

The conversion circuit 320 may include level shifters LS1 to LSn and decoders DEC1 to DECn. The level shifters LS1 to LSn may change the level of the image data DATA output from the latches LAT1 to LATn and may output the image data DATA having the changed level to the decoders DEC1 to DECn.

The decoders DEC1 to DECn may receive the image data DATA from the level shifters LS1 to LSn, may determine the analog voltage of the image data DATA, and may generate the gamma voltages GV by using the determined analog voltage. For example, the gamma voltages GV may be equal to the determined analog voltage.

In one or more examples, the decoders DEC1 to DECn may generate the gamma voltages GV by using the prestored reference gamma voltages, and may output the gamma voltages GV to the output circuit 330.

The output circuit 330 may include operational amplifiers AMP1 to AMPn and an output switching circuit 331.

The operational amplifiers AMP1 to AMPn may receive the gamma voltages GV output from the conversion circuit 320 and may generate data signals DS1 to DSn by amplifying the gamma voltages GV. In one or more examples, the operational amplifiers AMP1 to AMPn may amplify the gamma voltages GV by using the bias current BC (not shown) and the adjusting current AC transmitted from the output control circuit 340, thereby generating the data signals DS1 to DSn. That is, the bias current BC (not shown) and the adjusting current AC may be used as an operating current of the operational amplifiers AMP1 to AMPn.

As described above, the amplification process by the operational amplifiers AMP1 to AMPn may take a predetermined time, and this time may be represented by the slew rate. Here, when both the bias current BC and the adjusting current AC are applied to the operational amplifiers AMP1 to AMPn, the slew rate may be improved.

The operational amplifiers AMP1 to AMPn may output the data signals DS1 to DSn to the output switching circuit 331.

The output switching circuit 331 may switch the received data signals DS1 to DSn and output them to the display panel 100 through the channels CH1 to CHn. In one or more examples, the output switching circuit 331 may switch (hereinafter, referred to as a channel switching operation) the channels CH1 to CHn from which the data signals DS1 to DSn output from the respective operational amplifiers AMP1 to AMPn are output. For example, the output switching circuit 331 may output the first data signal DS1 through the first channel CH1 and the third data signal DS3 through the third channel CH3 in the first section, and may output the first data signal DS1 through the third channel CH3 and the third data signal DS3 through the first channel CH1 in the second section. That is, channel switching of the data signal may occur by the output switching circuit 331. As a result, the output of the output circuit 330 may be changed.

In one or more examples, the output switching circuit 331 may include a plurality of switches connected between the channels CH1 to CHn and the operational amplifiers AMP1 to AMPn, but is not limited thereto.

The output switching circuit 331 may perform the channel switching operation under the control of the controller 200. In one or more examples, the controller 200 may output a switching signal SS to the output switching circuit 331, and the output switching circuit 331 may perform the channel switching operation based on the switching signal SS. For example, the output switching circuit 331 may perform the channel switching operation based on the level of the switching signal SS. Since the channel switching is performed according to the change in the level of the switching signal SS, the output of the source driver 300 may change. Therefore, it can be understood that the output change signal OCS of the embodiments of the present disclosure includes the switching signal SS.

In one or more examples, when the switching signal SS is at the first level, the output switching circuit 331 may output the first data signal DS1 through the first channel CH1 and may output the third data signal DS3 through the third channel CH3. Also, when the switching signal SS is at the second level, the output switching circuit 331 may output the first data signal DS1 through the third channel CH3 and may output the third data signal DS3 through the first channel CH1.

As described above, the output of the source driver 300 may change by the level change of the switching signal SS output from the controller 200.

The controller 200 may output the adjustment initiation signal AIS to the output control circuit 340 in response to the level change of the switching signal SS. For example, the controller 200 may output the adjustment initiation signal AIS having the first level during a predetermined signal transition section based on a point of time when the level of the switching signal SS changes.

Figure 7:
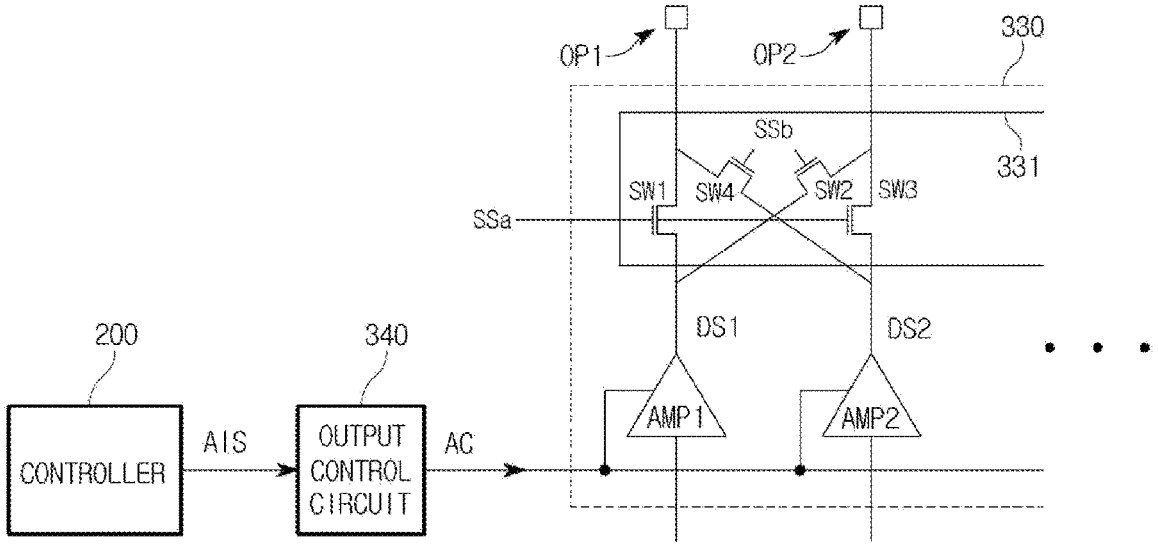
FIG. 7 is a diagram illustrating an example of the panel control circuit.

The output control circuit 340 may output the adjusting current AC to the output circuit 330 in response to the adjustment initiation signal AIS output from the controller 200. Consequently, the adjusting current AC may be selectively output to the output circuit 330 at a point of time when the level of the output change signal, which changes the output of the source driver 300 is changed. FIG. 7 is a diagram illustrating an example of the panel control circuit 2000. In one or more examples, the panel control circuit 2000 shown in FIG. 7 shows an example of the panel control circuit 2000 shown in FIG. 6. Illustratively, though the panel control circuit 2000 of FIG. 7 shows only two operational amplifiers AMP1 and AMP2, the embodiments of the present disclosure are not limited thereto.

In FIGS. 1 to 7, for example, the output switching circuit 331 may include first to fourth switches SW1 to SW4. The first switch SW1 and the second switch SW2 may be connected to the first operational amplifier AMP1, and the third switch SW3 and the fourth switch SW4 may be connected to the second operational amplifier AMP2.

The first switch SW1 connects the first operational amplifier AMP1 and the first output pad OP1. The second switch SW2 connects the first operational amplifier AMP1 and the second output pad OP2. The third switch SW3 connects the second operational amplifier AMP2 and the second output pad OP2. The fourth switch SW4 connects the second operational amplifier AMP2 and the first output pad OP1.

In one or more examples, the first switch SW1 and the third switch SW3 may be turned on in response to the first switching signal SSa output from the controller 200. For example, the first switch SW1 may connect the first operational amplifier AMP1 and the first output pad OP1 in response to the first switching signal SSa. The third switch SW3 may connect the second operational amplifier AMP2 and the second output pad OP2 in response to the first switching signal SSa. Accordingly, in response to the first switching signal SSa, the output circuit 330 may output, through the first output pad OP1, the first data signal DS1 output from the first operational amplifier AMP1, and may output, through the second output pad OP2, the second data signal DS2 output from the second operational amplifier AMP2.

In one or more examples, the second switch SW2 and the fourth switch SW4 may be turned on in response to a second switching signal SSb output from the controller 200. For example, the second switch SW2 may connect the first operational amplifier AMP1 and the second output pad OP2 in response to the second switching signal SSb. The fourth switch SW4 may connect the second operational amplifier AMP2 and the first output pad OP1 in response to the second switching signal SSb. Accordingly, in response to the second switching signal SSb, the output circuit 330 may output, through the second output pad OP2, the first data signal DS1 output from the first operational amplifier AMP1, and may output, through the first output pad OP1, the second data signal DS2 output from the second operational amplifier AMP2.

Therefore, depending on the change in the level of the switching signal SS that is the output change signal OCS, the connection state of the switches SW1 to SW4 changes, and thus, the output of the output circuit 330 changes.

In one or more examples, the first switching signal SSa and the second switching signal SSb may be complementary. The first switching signal SSa and the second switching signal SSb may be at one of the first level and the second level. When the first switching signal SSa is at the first level, the second switching signal SSb may be at the second level, and when first switching signal SSa is at the second level, the second switching signal SSb may be at the first level. For example, the first switching signal SSa may be a signal obtained by inverting the second switching signal SSb.

Figure 8:
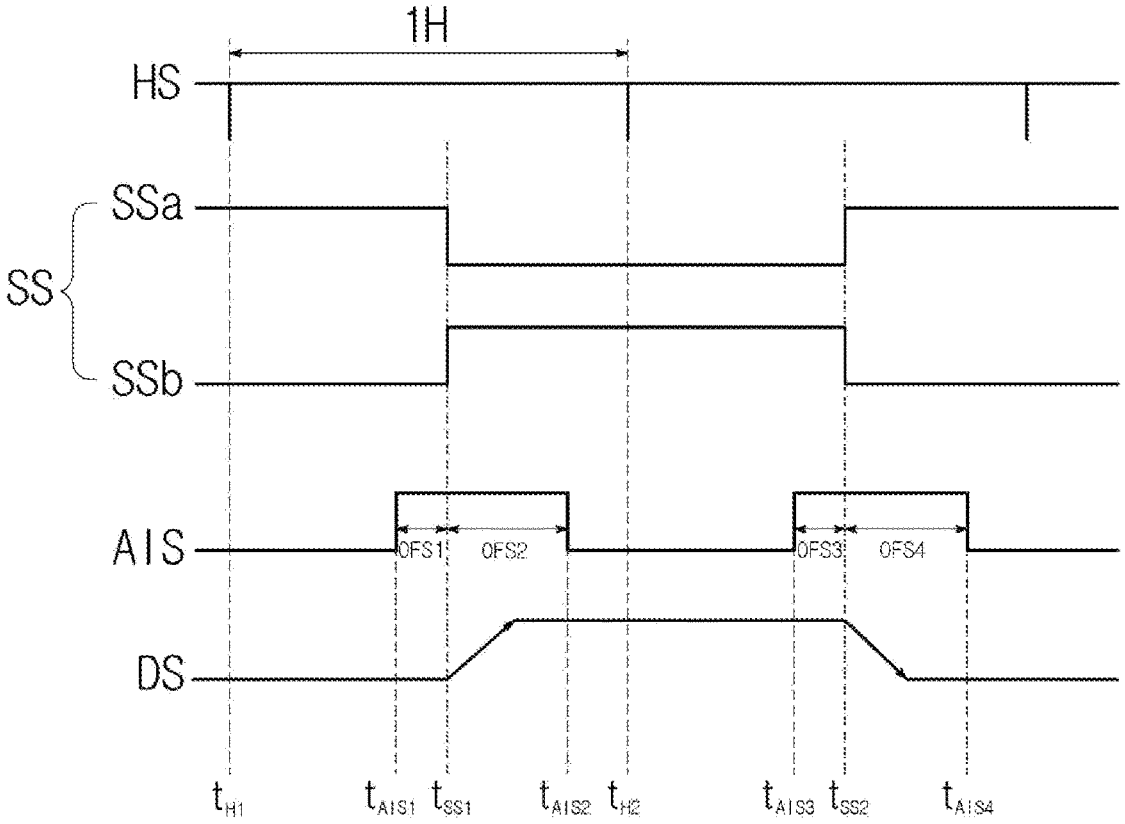
FIG. 8 is a diagram illustrating an example of a timing diagram describing the operation of the panel control circuit shown in FIG. 7.

FIG. 8 is a diagram illustrating an example of a timing diagram for describing the operation of the panel control circuit 2000 shown in FIG. 7. In FIGS. 1 to 8, as described above, the output switching circuit 331 is operated by the switching signals SSa and SSb (SS) output by the controller 200, and thus, the output of the output circuit 330 may be changed.

The controller 200 may output the adjustment initiation signal AIS having the first level (e.g., a high level), based on the point of time when the level of the switching signal SS changes. In one or more examples, the controller 200 may output the adjustment initiation signal AIS having the first level (e.g., a high level), based on a point of time when the logical level of the switching signal SS changes.

The controller 200 may output the adjustment initiation signal AIS having a timing in conjunction with the timing of the switching signal SS. In one or more examples, at least one of the rising edge and the falling edge of the adjustment initiation signal AIS may be based on the point of time when the level of the switching signal SS changes.

Meanwhile, in FIG. 8, since the level change point of the first switching signal SSa is the same as the level change point of the second switching signal SSb, a description will be made based on the first switching signal SSa.

The controller 200 may output the adjustment initiation signal AIS by using the timing setting value indicating a point of time at which the level of the first switching signal SSa and the timing setting value indicating the predetermined offset.

The controller 200 may output the adjustment initiation signal AIS having the first level during a section which is determined by a time point before the first offset OFS1 from the first level change point $t_{SS1}$ of the first switching signal SSa and by a time point after the second offset OFS2.

The controller 200 may output the adjustment initiation signal AIS having the first level during a section which is determined by a time point before the third offset OFS3 from the second level change point $t_{SS2}$ of the first switching signal SSa and by a time point after the fourth offset OFS4.

Accordingly, the controller 200 may output the adjustment initiation signal AIS having the first level to the output control circuit 340 in a signal transition section in which the level of the switching signal SS changes. The output control circuit 340 may output the adjusting current AC to the output circuit 330 in response to the adjustment initiation signal AIS having the first level. That is, the output control circuit 340 may output the adjusting current AC to the output circuit 330 during a predetermined signal transition section based on a point of time when the level of the switching signal SS changes.

In one or more examples, the first falling edge $t_{AIS2}$ of the adjustment initiation signal AIS may be located outside the 1H time period. For example, the first falling edge $t_{AIS2}$ of the adjustment initiation signal AIS and the first level change point $t_{SS1}$ of the switching signal SS may be located at different horizontal time periods. However, the embodiments of the present disclosure are not limited thereto.

As described above, when the level of the switching signal SS changes, the output of the source driver 300 changes, and an amplification operation is performed by the operational amplifiers AMP1 to AMPn in this signal transition section. In one or more examples of the present disclosure, since the output control circuit 340 outputs the adjusting current AC to the operational amplifiers AMP1 to AMPn in the signal transition section in which the level of the switching signal SS changes, not only the slew rate of the operational amplifiers AMP1 to AMPn can be improved, but also the increase in the power consumption caused by the application of adjusting current AC the can be minimized.

Figure 9:
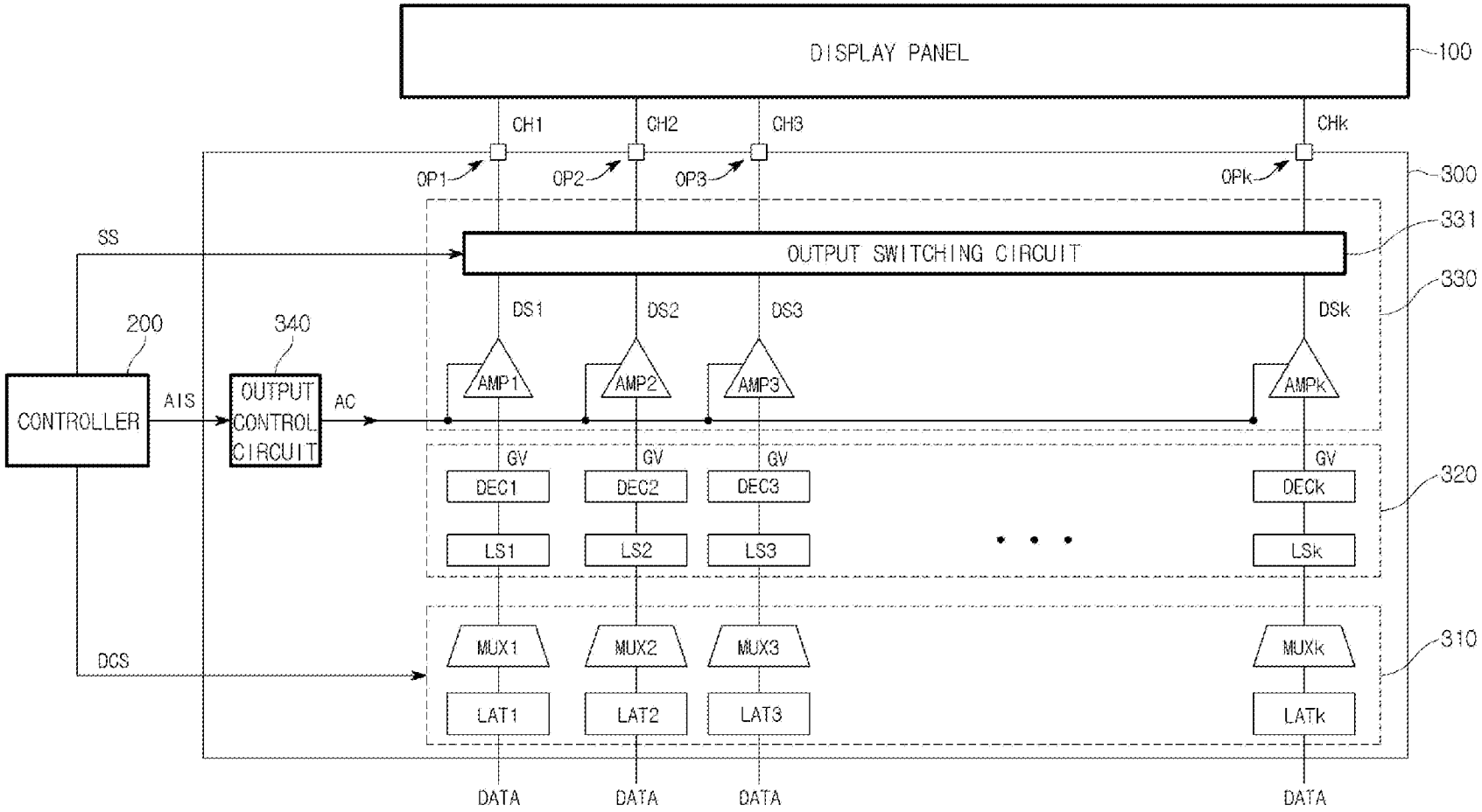
FIG. 9 is a diagram illustrating an example of a display panel and the panel control circuit.

FIG. 9 is a diagram illustrating an example of the display panel and the panel control circuit 2000. In FIGS. 1 to 9, the source driver 300 is connected to the display panel 100 by k channels CH1 to CHk, and the source driver 300 may include k output pads OP1 to OPk assigned to channels CH1 to CHk respectively.

Compared to FIG. 6, FIG. 9 is different from FIG. 6 in that the input circuit 310 of FIG. 9 further includes a plurality of multiplexers MUX1 to MUXk and the number of channels CH1 to CHk and the number of output pads OP1 to OPk are k (k≤n). Hereinafter, only the difference will be described.

The input circuit 310 may include a plurality of latches LAT1 to LATk and a plurality of multiplexers MUX1 to MUXk. The plurality of multiplexers MUX1 to MUXk may selectively output data output from the plurality of latches LAT1 to LATk to the conversion circuit 320. In one or more examples, the plurality of multiplexers MUX1 to MUXk may receive the first image data and the second image data from the plurality of latches LAT1 to LATk, and may output any one of the first image data and the second image data to the conversion circuit 320.

In one or more examples, the multiplexers MUX1 to MUXk may selectively output the image data output from the plurality of latches LAT1 to LATk to the conversion circuit 320 based on the control of the controller 200. In one or more examples, the controller 200 may output a data change signal DCS to the multiplexers MUX1 to MUXk, and the multiplexers MUX1 to MUXk may selectively output the image data to the conversion circuit 320 based on the data change signal DCS. For example, the multiplexers MUX1 to MUXk may operate based on the level of the data change signal DCS. Since the image data output from the multiplexers MUX1 to MUXk changes according to the data change signal DCS, the output of the source driver 300 may consequently change according to the data change signal DCS.

In one or more examples, the multiplexers MUX1 to MUXk may output the first image data among the first image data and the second image data to the conversion circuit 320 when the data change signal DCS is at the first level. The multiplexers MUX1 to MUXk may output the second image data among the first image data and the second image data to the conversion circuit 320 when the data change signal DCS is at the second level.

As described above, the output of the source driver 300 may change by the level change in data change signal DCS output from the controller 200.

The output control circuit 340 may output the adjusting current AC to the output circuit 330 in response to the adjustment initiation signal AIS output from the controller 200. Here, the adjustment initiation signal AIS having the first level at a point of time when the level of the data change signal DCS changes may be output and the output control circuit 340 may output the adjusting current AC to the output circuit 330 in response to the adjustment initiation signal AIS. That is, the output control circuit 340 may selectively output the adjusting current AC to the output circuit 330 at the point of time when the level of the data change signal DCS that changes the output of the source driver 300 changes. For example, the output control circuit 340 may supply the adjusting current AC to the output circuit 330 for a certain period of time before and after a signal transition section in which the level of the data change signal DCS changes.

Figure 10:
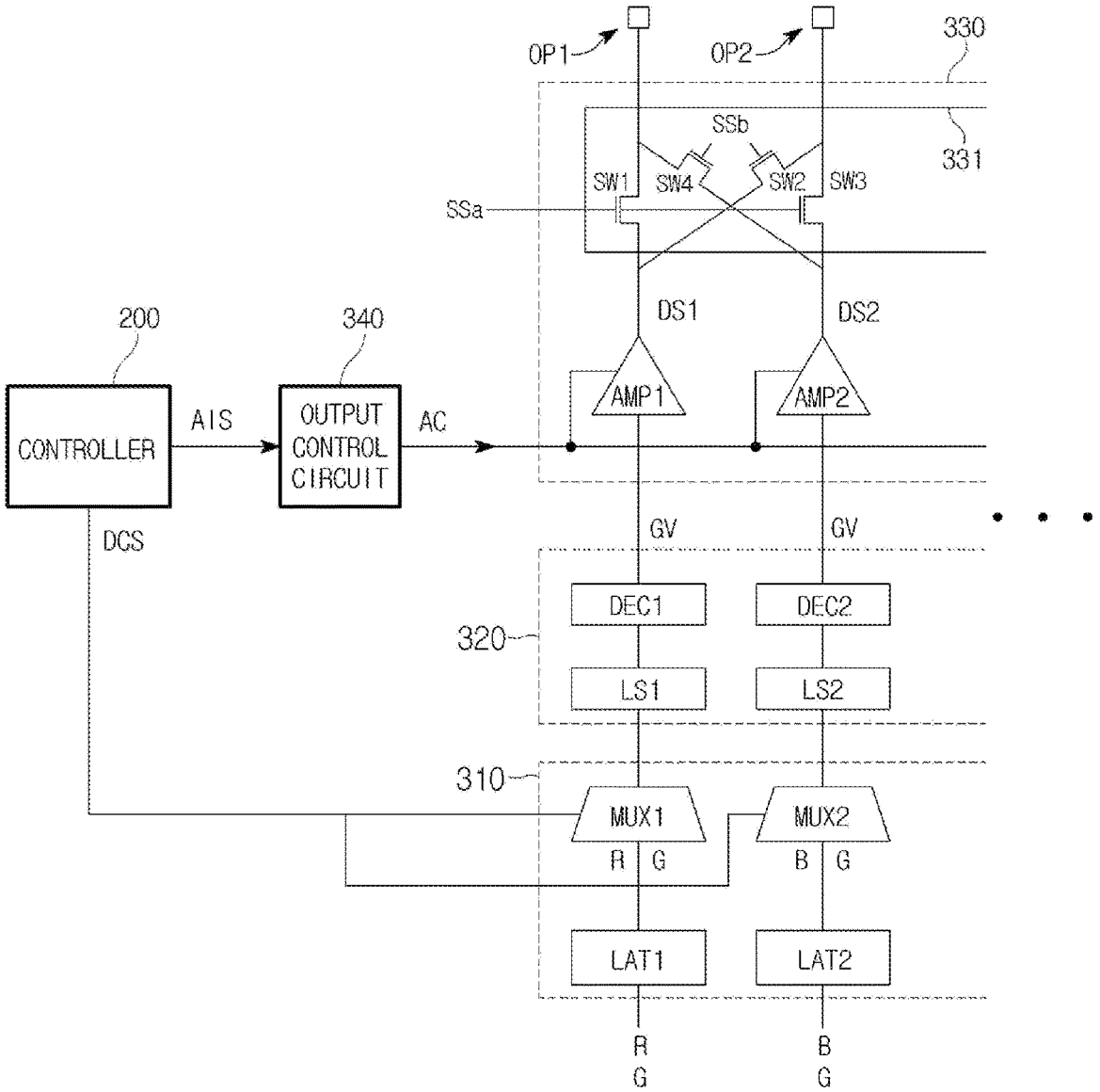
FIG. 10 is a diagram illustrating an example of the panel control circuit.

FIG. 10 is a diagram illustrating an example of the panel control circuit 2000. In one or more examples, the panel control circuit 2000 shown in FIG. 10 shows an example of the panel control circuit 2000 shown in FIG. 9. Illustratively, though the panel control circuit 2000 of FIG. 10 shows only two operational amplifiers AMP1 and AMP2, the embodiments of the present disclosure are not limited thereto.

In FIGS. 1 to 10, the output switching circuit 331 may include first to fourth switches SW1 to SW4. The first switch SW1 and the third switch SW3 may be turned on in response to the first switching signal SSa output from the controller 200. Also, the second switch SW2 and the fourth switch SW4 may be turned on in response to the second switching signal SSb output from the controller 200.

The first multiplexer MUX1 may selectively output image data R and G output from the first latch LAT1. In one or more examples, the first multiplexer MUX1 may output any one of the image data R and G to the conversion circuit 320. The second multiplexer MUX2 may selectively output image data B and G output from the second latch LAT2. In one or more examples, the second multiplexer MUX2 may output any one of the image data B and G to the conversion circuit 320.

The controller 200 may output the data change signal DCS the multiplexers MUX1 and MUX2. The multiplexers MUX1 and MUX2 may selectively output the image data to the conversion circuit 320 based on the data change signal DCS. In one or more examples, in response to the data change signal DCS at the first level, the first multiplexer MUX1 may output image data R among the image data R and G, and the second multiplexer MUX2 may output image data B among the image data B and G. Also, in response to the data change signal DCS at the second level, the first multiplexer MUX1 may output image data G among the image data R and G, and the second multiplexer MUX2 may output image data G among the image data B and G. Accordingly, depending on the change in the level of the data change signal DCS, the image data output from the multiplexers MUX1 and MUX2 is changed, and thus, the output of the output circuit 330 is changed.

Figure 11:
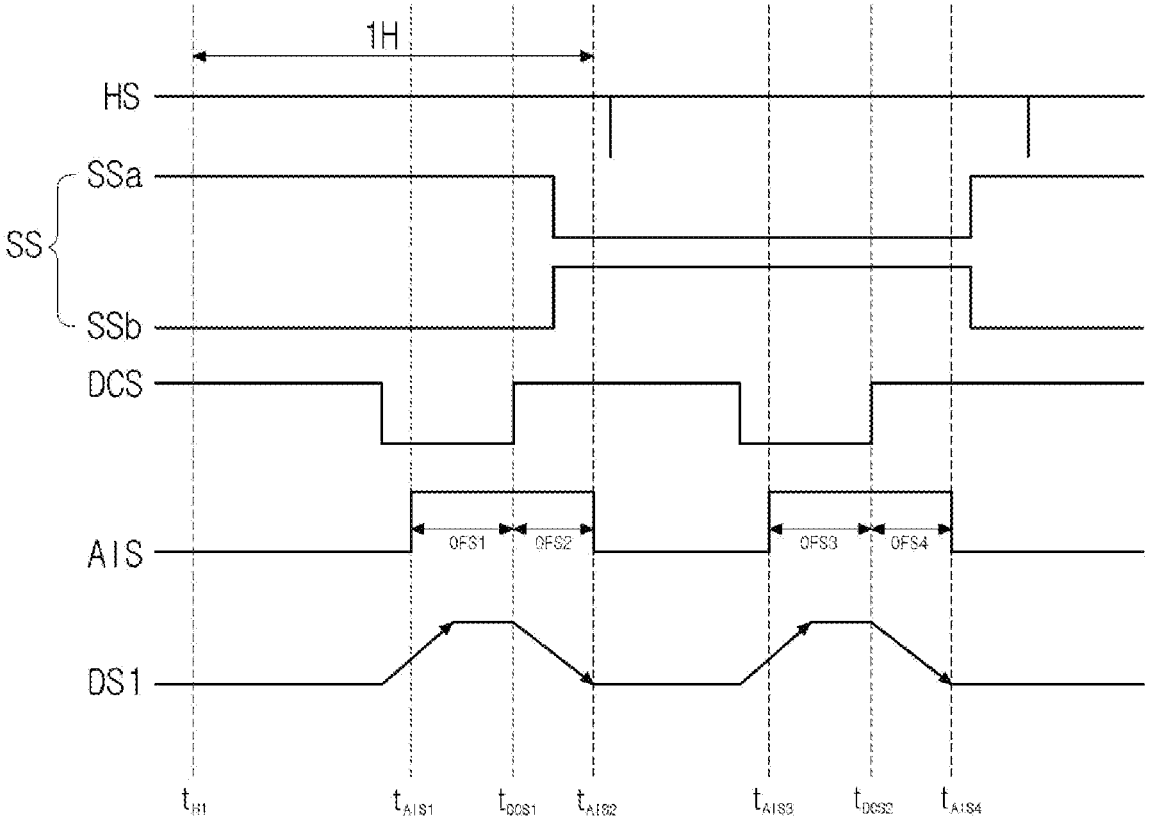
FIG. 11 is a diagram illustrating an example of a timing diagram for describing the operation of the panel control circuit shown in FIG. 10.

FIG. 11 is a diagram illustrating an example of a timing diagram for describing the operation of the panel control circuit 2000 shown in FIG. 10. In FIGS. 1 to 11, as described above, the image data output from the multiplexers MUX1 and MUX2 is changed by the data change signal DCS output by the controller 200, and thus, the output of the output circuit 330 may be changed.

The controller 200 may output the adjustment initiation signal AIS having the first level (e.g., a high level), based on the point of time when the level of the data change signal DCS changes. In one or more examples, the controller 200 may output the adjustment initiation signal AIS having the first level (e.g., a high level), based on a point of time when the logical level of the data change signal DCS changes.

The controller 200 may output the adjustment initiation signal AIS having a timing in conjunction with the timing of the data change signal DCS. In one or more examples, at least one of the rising edge and the falling edge of the adjustment initiation signal AIS may be based on the point of time when the level of the data change signal DCS changes.

The controller 200 may output the adjustment initiation signal AIS by using the timing setting value indicating a point of time at which the level of the data change signal DCS and the timing setting value indicating the predetermined offset.

The controller 200 may output the adjustment initiation signal AIS having the first level during a section which is determined by a time point before the first offset OFS1 from the first level change point $t_{DCS1}$ of the data change signal DCS and by a time point after the second offset OFS2.

The controller 200 may output the adjustment initiation signal AIS having the first level during a section which is determined by a time point before the third offset OFS3 from the second level change point $t_{DCS2}$ of the data change signal DCS and by a time point after the fourth offset OFS4.

In one or more examples, the first falling edge $t_{AIS2}$ of the adjustment initiation signal AIS may be located outside the 1H time period. For example, the first falling edge $t_{AIS2}$ of the adjustment initiation signal AIS and the first level change point $t_{DCS1}$ of the data change signal DCS may be located at different horizontal time periods. However, the embodiments of the present disclosure are not limited thereto.

Meanwhile, in the example of FIG. 11, it is shown that the level change points $t_{OCS1}$ and $t_{DCS2}$ of the data change signal DCS are shown as a point of time when the level of the data change signal DCS is changed from the second level to the first level. However, the embodiments of the present disclosure are not limited to this. For example, at least one of the level change points $t_{OCS1}$ and $t_{DCS2}$ may be a point of time when the level of the data change signal DCS is changed from the first level to the second level.

The controller 200 may output the adjustment initiation signal AIS having the first level to the output control circuit 340 in a signal transition section in which the level of the data change signal DCS changes. The output control circuit 340 may output the adjusting current AC to the output circuit 330 in response to the adjustment initiation signal AIS having the first level. That is, the output control circuit 340 may output the adjusting current AC to the output circuit 330 during a predetermined signal transition section based on a point of time when the level of the data change signal DCS changes.

As described above, when the level of the data change signal DCS changes, the output of the source driver 300 changes, and an amplification operation is performed by the operational amplifiers AMP1 to AMPk in this signal transition section. In one or more examples of the present disclosure, since the output control circuit 340 outputs the adjusting current AC to the operational amplifiers AMP1 to AMPk in the signal transition section in which the level of the data change signal DCS changes, not only the slew rate of the operational amplifiers AMP1 to AMPk can be improved, but also the increase in the power consumption caused by the application of adjusting current AC the can be minimized.

The operation method of the panel control circuit 2000 or the controller in one or more examples of the present disclosure may be implemented with instructions which are stored in a computer-readable storage medium and executed by the processor.

Directly and/or indirectly and regardless of whether the storage media is in a raw state, in a formatted state, an organized state, or in any other accessible state, the storage media may include a relational database, a non-relational database, an in-memory database, and a database which can store a data and include a distributed type database, such as other suitable databases that allows access to the data through a storage controller. In addition, the storage medium includes a primary storage device, a secondary storage device, a tertiary storage device, an offline storage device, a volatile storage device, a non-volatile storage device, a semiconductor storage device, a magnetic storage device, an optical storage device, and a flash storage devices, a hard disk drive storage device, a floppy disk drive, a magnetic tape, or any type of storage device such as other suitable data storage medium.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A panel control circuit configured to control a display panel comprising a plurality of pixels, the panel control circuit comprising:

a controller configured to output an image data; and a source driver, comprising an output circuit and an output control circuit, and configured to generate data signals based on the image data, wherein the controller is configured to output an output change signal for changing an output of the source driver, the output circuit is configured to output the data signals to the display panel, and the output control circuit is configured to selectively output an adjusting current to the output circuit in a signal transition section of the output change signal so as to control a slew rate of the output circuit.

2. The panel control circuit of claim 1, wherein the source driver is further configured to change a level of the data signal in response to the output change signal.

3. The panel control circuit of claim 1, wherein the source driver further comprises an input circuit configured to process the image data and output the processed image data, and a conversion circuit configured to generate gamma voltages based on the processed image data, wherein the output circuit comprises operational amplifiers configured to convert the gamma voltages into the data signals and output the data signals, and wherein the output control circuit is configured to transmit the adjusting current to the operational amplifiers.

4. The panel control circuit of claim 3, wherein the input circuit comprises latches configured to latch the image data and output the latched image data to the conversion circuit in response to the output change signal.

5. The panel control circuit of claim 3, wherein the input circuit comprises multiplexers configured to receive a first image data and a second image data, and output any one of the first image data and the second image data to the conversion circuit in response to the output change signal.

6. The panel control circuit of claim 3, wherein the output circuit further comprises an output switching circuit configured to switch the data signals output from the operational amplifiers in response to the output change signal.

7. The panel control circuit of claim 6, wherein the output switching circuit comprises:

a first switch configured to connect a first operational amplifier, among the operational amplifiers, and a first output pad of the source driver; and a second switch configured to connect the first operational amplifier and a second output pad of the source driver, and wherein the first switch and the second switch are turned on and turned off in response to the output change signal.

8. The panel control circuit of claim 1, wherein the output control circuit is further configured to output the adjusting current to the output circuit in a predetermined signal transition section based on a point of time when the level of the output change signal changes.

9. The panel control circuit of claim 1, wherein the controller is further configured to generate an adjustment initiation signal having a first level in a predetermined signal transition section based on a point of time when the level of the output change signal changes, and output the generated adjustment initiation signal to the output control circuit, and wherein the output control circuit is further configured to transmit the adjusting current to the output circuit in response to the adjustment initiation signal.

10. The panel control circuit of claim 9, wherein the output control circuit is further configured to transmit the adjusting current and a bias current to the output circuit when the adjustment initiation signal is at the first level, and only transmit the bias current, among the adjusting current and the bias current, to the output circuit when the adjustment initiation signal is at a second level different from the first level.

11. The panel control circuit of claim 9, wherein the controller is further configured to set timings of a rising edge and a falling edge of the adjustment initiation signal based on a point of time when the level of the output change signal changes.

12. The panel control circuit of claim 11, wherein the falling edge of the adjustment initiation signal and the point of time when the level of the output change signal changes are located at different horizontal time periods.

13. The panel control circuit of claim 9, wherein the controller comprises a memory configured to store a timing setting value, and determines the predetermined signal transition section based on the timing setting value stored in the memory and the point of time when the level of the output change signal changes.

14. The panel control circuit of claim 1, wherein the output control circuit comprises:

an adjusting circuit configured to output the adjusting current; and a switch configured to connect the adjusting circuit and the source driver and to output the adjusting current to the source driver in the signal transition section in which the level of the output change signal changes.

15. The panel control circuit of claim 1, wherein the panel control circuit is disposed in a display device.

16. A display device comprising:

a display panel comprising a plurality of pixels;

a controller configured to output an image data; and a source driver comprising an output circuit and an output control circuit, configured to generate data signals based on the image data, wherein the controller is configured to:

output an output change signal for changing an output of the source driver;

generate an adjustment initiation signal having a first level in a predetermined signal transition section, based on a point of time when the level of the output change signal changes; and output the generated adjustment initiation signal to the output control circuit, wherein the output circuit is configured to output the data signals to the display panel, and wherein the output control circuit is configured to:

transmit a bias current to the output circuit and transmit an adjusting current to the output circuit in a signal transition section of the output change signal; and transmit the adjusting current to the output circuit in response to the adjustment initiation signal.

17. The display device of claim 16, wherein the output control circuit is further configured to output the adjusting current to the output circuit in a predetermined signal transition section based on a point of time when the level of the output change signal changes.

18. The display device of claim 16, wherein the output control circuit is further configured to transmit the adjusting current and a bias current to the output circuit when the adjustment initiation signal is at the first level, and only transmit the bias current, among the adjusting current and the bias current, to the output circuit when the adjustment initiation signal is at a second level different from the first level.

19. The display device of claim 18, wherein the controller is further configured to set timings of a rising edge and a falling edge of the adjustment initiation signal based on a point of time when the level of the output change signal changes.

20. The display device of claim 19, wherein the falling edge of the adjustment initiation signal and the point of time when the level of the output change signal changes are located at different horizontal time periods.

* * * * *